United States Patent [19]

Lavelle

[11] Patent Number: 4,742,426

[45] Date of Patent: May 3, 1988

[54] ELECTRONIC LOCKING APPARATUS

[75] Inventor: Gary E. Lavelle, Avon, Conn.

[73] Assignee: Emhart Industries, Inc., Farmington, Conn.

[21] Appl. No.: 31,712

[22] Filed: Mar. 27, 1987

[51] Int. Cl.[4] ..... H01H 47/00

[52] U.S. Cl. ..... 361/171; 361/172; 340/825.31

[58] Field of Search ..... 361/171, 172; 340/825.31; 70/277, 278, 280

[56] References Cited

U.S. PATENT DOCUMENTS 4,495,540 1/1985 Remington et al. ..... 361/172

4,499,462 2/1985 Stoesser et al. ..... 361/172

*Primary Examiner*—Michael L. Gellner

*Assistant Examiner*—David M. Gray

*Attorney, Agent, or Firm*—Barry E. Deutsch

[57] ABSTRACT

A battery powered electronic lock includes a control for indicating low battery voltage and reserving a portion of the battery's energy for operating the lock upon insertion of maintenance or emergency keys.

18 Claims, 5 Drawing Sheets

START
59
READ CARD
60
LOW BATTERY ACCESS CARD ?
62
YES
SET FLAG 3
94
NO
MATCH ?
64
NO
YES
FLAG 1 SET ?
66
NO
YES
FLASH RED LED
68
FLAG 2 SET ?
70
YES
EMERGENCY CARD ?
90
NO
FLAG 3 SET ?
92
NO
NO
YES
YES
ACTIVATE SOLENOID(s)
72
ACTIVATE GREEN LED
73
MEASURE BATTERY VOLTAGE
74
DEACTIVATE SOLENIOD(S)
76
RESET FLAG 3
78
A
B
C

D

E
80
BATTERY VOLTAGE ≤ V1 ?
NO
YES
83
RESET FLAG 1
SET COUNTER=N
81
SET FLAG 1
89
END
84

A
B
C

82
REST FLAG 1, FLAG 2
BATTERY VOLTAGE ≤ V1 ?
80
SET FLAG 1
81
BATTERY VOLTAGE ≤ V2 ?
86
SET FLAG 2
88
END
84

ELECTRONIC LOCKING APPARATUS

BACKGROUND OF THE INVENTION

The invention relates generally to battery powered electronic locking apparatus and deals more particularly with a control for indicating low battery voltage and reserving a portion of the battery's energy for operating the lock upon insertion of selected keys.

Battery powered electronic locks were previously known which include a red LED mounted on an outer housing of the lock to indicate low battery voltage or the insertion of an invalid card, and a green LED mounted on the outer housing to indicate a valid card and unlocked status of the lock. Upon insertion of a valid key card, the lock will be opened and the red LED will not be activated if the battery voltage is above a certain level, but activated if the battery voltage is below the certain level. This electronic lock is programmable during installation to provide such activation of the red LED either upon insertion of every valid key card or insertion of only those valid key cards associated with maintenance people. After each insertion of a valid key card subsequent to the battery voltage dropping to or below the certain level, the red LED is activated and the lock opened until the battery becomes so drained that it does not provide sufficient voltage to operate the lock.

There are two problems with this system. If the warning provided by the red LED is not noticed by a maintenance person, or if noticed, not heeded in time, the lock may not be capable of opening during an emergency situation. Also, the batteries of this type of electronic lock are accessible only from the inside of the door, and if the lock is rendered inoperable, such access may be precluded.

Another battery powered electronic lock is described in U.S. Pat. No. 4,148,092 to Martin. It briefly discloses a battery voltage indicating means which sounds an audio alarm when the battery voltage drops below a certain level, and allows access. The battery voltage indicating means is also supposed to maintain the lock open a given number of operations after the sounding of the alarm to prevent lock-out. The door will remain unlocked until a maintenance person changes the batteries, and this may not be desirable under many circumstances.

Accordingly, a general object of the present invention is to provide a control for a battery powered lock which indicates low battery voltage and reserves a portion of the battery's energy for operation of the lock upon insertion of maintenance, emergency, or other selected keys or key cards.

SUMMARY OF THE INVENTION

The invention is an improvement to an electronic lock having a battery means for powering the lock, means for reading a key-card or other key, a lock operator and an alarm for indicating a low battery voltage condition. The improvement comprises first means for activating the lock operator but not activating the alarm when a valid key-card is inserted and read, and the battery voltage is relatively high, second means for activating the alarm and the lock operator when a valid key-card is inserted and read and the battery voltage is relatively low, third means for activating the alarm but not the lock operator when a valid key-card is inserted and read and the battery voltage is still lower. The battery means contains sufficient energy and outputs sufficient voltage to drive the lock operator at the still lower voltage level.

Consequently, a portion of the battery's energy is reserved to operate the lock after the lock is substantially drained, and security is maintained until the batteries are changed. According to one feature of the invention, after the battery voltage has dropped to the still lower level, the lock is operable either by a maintenance or an emergency card.

DETAILED DESCRIPTION OF THE PREFERRED EMBODIMENTS

Figure 1:
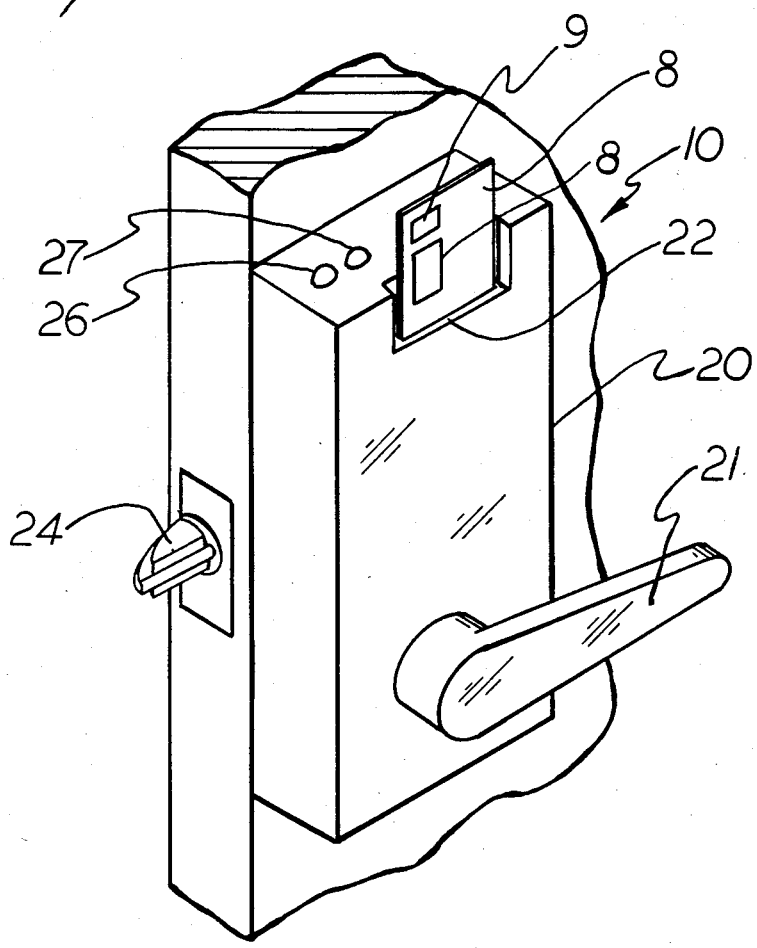
FIG. 1 is a perspective view of an electronic lock in which the invention is embodied.

FIG. 1 illustrates an electronic locking apparatus generally designated 10 in which the invention is embodied. The apparatus 10 includes an outer housing 20 and a recess 22 within the housing 20 to receive a key card 23. The key card 23 contains lock combination data 8 and status data 9 stored in magnetic form. Assuming the key card 23 is valid for the lock 10, the lock combination data corresponds to one or more lock combinations stored within the lock and the status data 9 indicates the type of card, normal access, maintenance or emergency. By way of example, the key card 23 is a normal access key card of the type used by a patron of a hotel, an employee of a company, or a resident of a dormitory outfitted with the locking apparatus 10. The locking apparatus 10 also includes a latch bolt 24 and a handle 21 for operating the latch bolt 24 when the locking apparatus is opened. The electronic locking apparatus 10 further includes a light emitting diode (LED) 27 which indicates when the electronic lock is unlocked and a LED 26 which indicates a low battery voltage condition. By way of example, the LED 27 is green and the LED 26 is red, and the LED 26 is operated in a flashing mode to indicate the low battery voltage condition.

Figure 2:
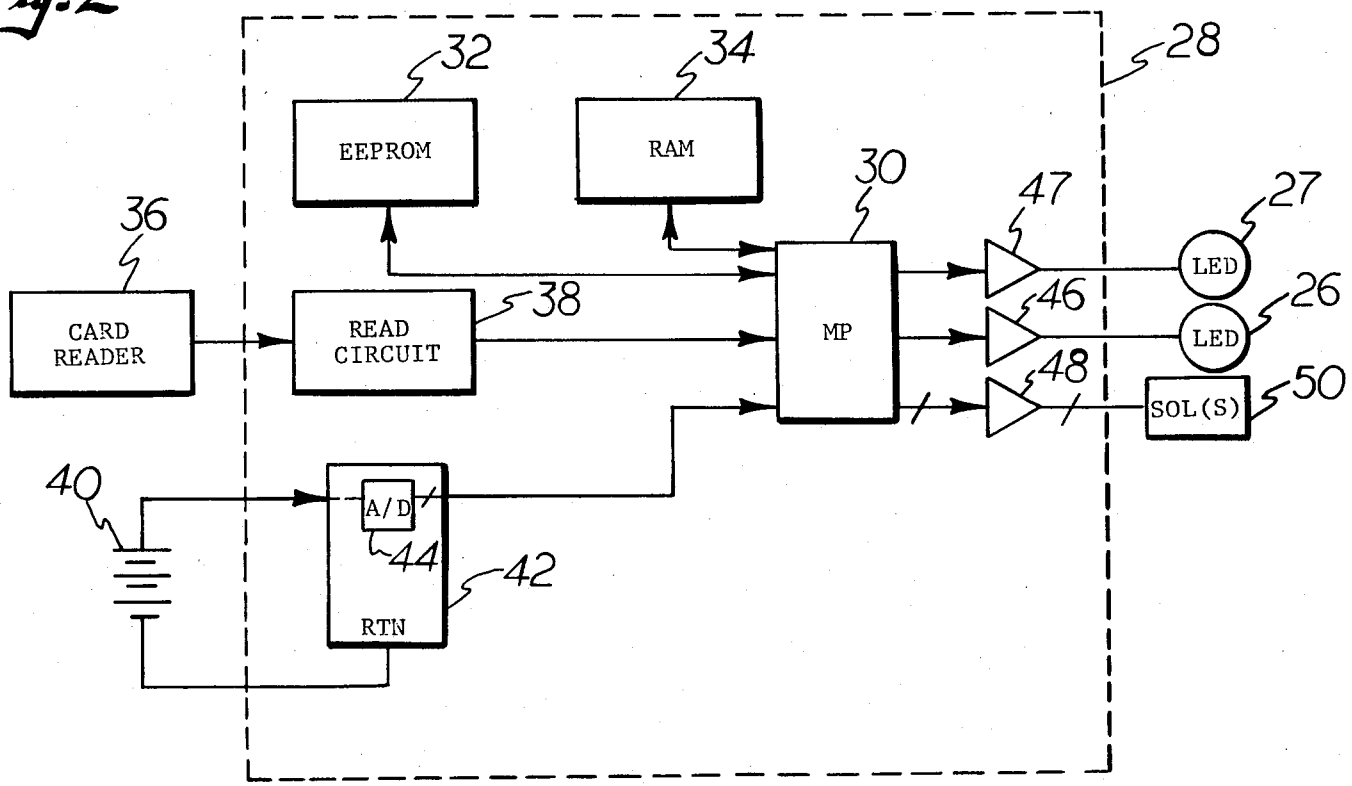
FIG. 2 is a block diagram which schematically illustrates electronic components of the electronic lock of FIG. 1.

FIG. 2 illustrates electronic components of an electronic module 28 and other components within the electronic locking apparatus 10. Electronic module includes a microprocessor 30, an electrically erasable programmable read-only memory (EEPROM) 32 which supplies an operating program for the microprocessor 30 and also stores lock access combinations, and a random access memory (RAM) 34 which stores lock combinations obtained from the key card 23 and otherwise serves as a work space and temporary memory for the microprocessor 30. If desired, the microprocessor 30 and RAM 34 may be provided by a microcomputer. The other components include a card reader 36 which is adapted to read the magnetic data on the key card 23 and supply corresponding signals to a read circuit 38 contained within the electronic module 28 which read circuit includes processing circuitry to convert the output signals of the card reader to digital format for transmission to the microprocessor 30. The other components also include one or more batteries indicated collectively as a single battery means 40 whose collective voltage is sensed by a battery voltage sensor 42 contained within the electronic module 28. By way of example, the battery means 40 comprise three lithium batteries connected in series, three volts per battery when fresh. Also, the battery voltage sensor 42 comprises an analog to digital converter 44 whose digital output is connected to the microprocessor 30 so that the microprocessor is able to read the voltage of the battery means 40. Electronic module 28 also includes a buffer or driver 46 by which the microprocessor 30 is able to drive the light emitting diode 26 and a buffer or driver 47 by which the microprocessor 30 is able to drive the light emitting diode 27. As noted above in the aforesaid example, the LED 27 is driven by the microprocessor 30 in a flashing mode and the LED 26 in a continuous mode for a predetermined duration. Electronic module 28 also includes one or more buffers or drivers 48 by which the microprocessor 30 is able to drive one or more solenoids 50 contained within the electronic locking apparatus 10 for operating the lock.

Figure 3A:
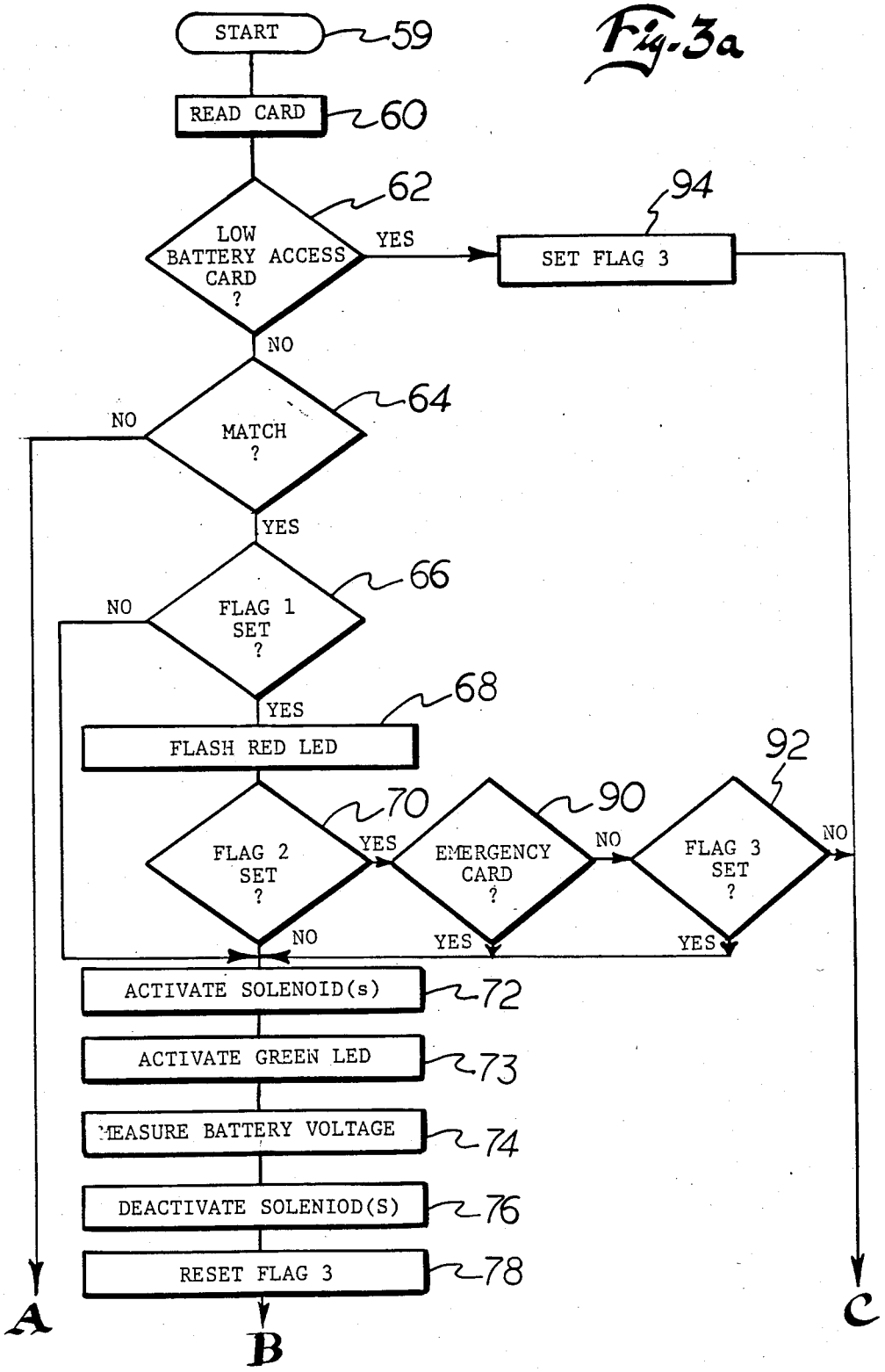
FIGS. 3(*a*) and (*b*) are top and bottom portions, respectively of a flow chart illustrating a computer program stored within the electronic lock of FIG. 1 for operating a microprocessor within the lock according to the invention.
Figure 3B:
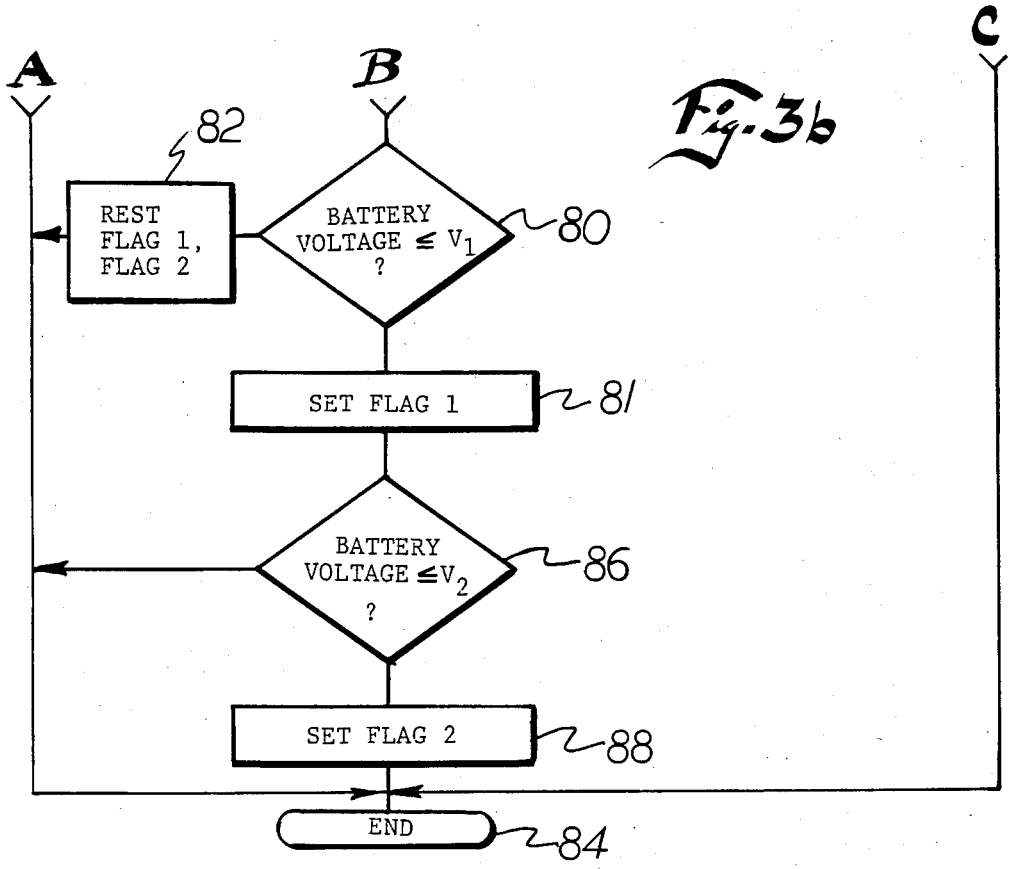

FIG. 3 is a flow chart illustrating a computer program stored within the EEPROM 32 for operating the microprocessor 30 according to the present invention. Upon insertion of the key card 23 in the recess 22, a start switch (not shown) contained within the electronic lock is closed to power up the electronic module 28 and begin operation of the microprocessor 30 (step 59). Next, the microprocessor 30 reads the output of the read circuit 38 and thereby reads the data contained on the key card 23 (step 60). Next, the microprocessor 30 determines whether data contained on the key card 23 indicates that the key card is a special low battery access card (step 62) whose function will be described below. Because the key card 23 is a normal access card for a motel patron, dormitory resident, or employee, the microprocessor skips to the step 64 in which it compares one or more lock combinations stored on the key card 23 to one or more lock combinations stored in the RAM 34 or EEPROM 32. If the comparison is not favorable, then the microprocessor jumps to the step 84 and powers down without operating the solenoids 50. However, if the comparison is favorable indicative of a "valid" key card, the microprocessor determines whether a flag number one has been set (step 66). As noted below, the flag one is set when the battery voltage has dropped to or below a first predetermined voltage, V1. Assuming that the battery 40 is fresh, flag one will not ordinarily be set and the microprocessor then activates the solenoids 50 (step 72) and turns-on the green LED 27 (step 73). During activation, the microprocessor reads the output of the battery voltage sensor 42 to determine the battery voltage under load (step 74) and then after a predetermined time sufficient to drive a locking mechanism to its opened state, the microprocessor deactivates the solenoids 50 (step 76). Next, for reasons discussed below, the microprocessor resets or clears a flag number 3 (step 78). Then, the microprocessor compares the battery voltage in the step 74 to the predetermined battery voltage level, V1, to determine whether the battery voltage has dropped below the V1 level. Assuming this is not yet true, the microprocessor clears or resets flags 1 and 2 to indicate that the battery voltage is above the level V1 (step 82). Then, the microprocessor jumps to the step 84 in which it powers down.

Upon subsequent insertions of the key card 23 or other valid normal access cards, the electronic locking apparatus 10 is operated in the same mode until the battery voltage drops to or below the level V1 under load as noted in the step 80. At which point the microprocessor proceeds to set the flag 1 indicative of this battery voltage condition (step 81). Then, the microprocessor determines whether the battery voltage measured in the step 74 is also less than or equal to a second predetermined voltage level, V2 which is less than the first predetermined level V1 (step 86). By way of example, the voltage of the battery 40 when fresh equals nine volts, the reference voltage, V1, is six volts under load and the reference voltage, V2 is 5.5 volts under load. Under normal conditions, the first time that the battery voltage drops to or below the voltage level V1, it will not be below the voltage level, V2 so that the microprocessor jumps to the end step 84 without setting the flag 2. Although the following should not be construed as a limitation on the present invention, after the foregoing insertion of the key card 23, the lock is opened and the red LED 27 is not flashed.

During subsequent insertions of the key card 23 or other valid key cards, the data on the key card 23 is read (step 60) and the microprocessor 30 notes a match of the data on the key card to one or more lock combinations stored in the RAM 34 (step 64) or EEPROM 32. As a result the microprocessor next determines whether the flag 1 has been set (step 66) and upon noting this condition, flashes the red LED 27 a predetermined number of times (step 68). This is intended to alert the holder of the card to a low battery voltage condition. Next, the microprocessor determines whether the flag 2 has been set (step 70) and because this is probably not yet true, the microprocessor activates the solenoids 50 to operate the lock (step 72). Then, the microprocessor activates the green LED 26 (step 73) and then measures the battery voltage (step 74). After the time necessary to operate the locking mechanism, the microprocessor 76 deactivates the solenoids 50 (step 76) and green LED (step 73) as noted above and then resets the flag 3 (step 78). Then, the microprocessor again compares the battery voltage to the first reference level, V1, (step 80) and after noting that the battery voltage is less than the voltage V1 again sets the flag 1 (step 84). Then the microprocessor 30 compares the battery voltage to the lower second reference level, V2, (step 86). Under normal circumstances, the battery voltage has not yet dropped to the level V2 so that the microprocessor proceeds to the end step 84. The foregoing sequence of events characterized by the flashing of the red LED 27 and the operation of the lock may be repeated many times before the battery voltage drops to the level, V2, and typically during such operations a maintenance person will learn of the low battery voltage condition and change the battery as follows. All that is necessary under these conditions is for the maintenance person to have either a normal access, low battery access or emergency card which is capable of opening the lock. Then, the battery 40 may be accessed, removed and changed. Then, the maintenance person may insert the normal access or other key card into the recess 22 to test the new batteries and reset the flag 1 as follows. The microprocessor proceeds from step 59 through 60, 64, 66, 68, 70, 72, 73, 74, 76, 78, and then to step 80. It should be noted that in the foregoing steps the flag 1 was still set and the microprocessor flashed the red LED 68 before opening the lock. Then, in the step 80, the microprocessor notes that the battery voltage is not less than or equal to the reference level of V1 so that the microprocessor clears or resets the flags 1 and 2 (step 82) and proceeds to the end step 84. Thereafter, until the battery voltage drops to the level V1, the normal access key card 23 will operate the lock without activation of the red LED 26.

Assuming now that the maintenance person did not change the battery after the battery voltage dropped to the first reference level, V1. The key card 23 is able to open the lock for a multitude of times before the battery voltage drops to level V2 and during such operations the red LED is activated. Then, when the microprocessor 30 senses that the battery voltage has dropped to or below the second reference level, V2, (step 86), the microprocessor proceeds to set the flag 2 (step 88) and then jumps to the end step 84. Upon the next insertion of a key card 23, the microprocessor reads the card (step 60), notices a match (step 64) and then determines that the flag 1 is still set (step 66). Consequently, the microprocessor flashes the red LED 26 (step 68) and then checks whether the flag 2 (step 70) is set. Because the flag 2 is set, the microprocessor now determines whether the key card 23 is an emergency card and because it is not, determines whether the flag 3 has been set (step 92) indicative of the insertion of a low battery access card described below, and then jumps to the end step 84 to power down the electronic module 28 without operating the lock. The foregoing process is in keeping with the invention because when the battery voltage has dropped to the level V2, the battery still contains sufficient energy at a sufficient battery voltage to drive the solenoids 50 and open the lock; however, security is maintained and such energy is reserved for either the insertion of an emergency card (detected by the step 90) or the changing of the battery which is signalled either by the insertion of the emergency card or a low battery access card. If the key card 23 is inserted by a hotel patron, dormitory resident, employee or other normal card holder, such card holder may report the problem to a maintenance person or such condition may be noticed by a maintenance person. In either event, the maintenance person should now be aware of the fact that the batteries are in need of changing.

It should also be noted that under the foregoing conditions, if an emergency card is inserted in the recess 22, the microprocessor will notice the emergency status of the card from its data, and even though the flag 1 has been set and the flag 2 has been set, when the microprocessor reaches the step 90, the microprocessor will proceed to the step 72 to open the lock.

If instead of the insertion of an emergency card at this point, a maintenance person inserts a low battery access card, the microprocessor reads the status of this card in the step 60 and after noticing the status, (step 62), proceeds to set the flag 3 (step 94) indicative of the insertion of the low battery access card. Then, the microprocessor jumps to the end step 84. This maintenance person should then insert a normal access card to operate the lock as follows. Upon insertion of this normal access card, the microprocessor proceeds from the step 59 to the steps 60, 62, 64, 66, 68, 70, 90, and 92 in sequence and then after noticing that the flag 3 has been set proceed to the step 72 to open the lock. Then, after proceeding through the steps 72, 73, 74, 76 and 78, the microprocessor then proceeds through the steps 80, 81, 86, and 88 setting the flags 1 and 2 again, because the batteries have not yet been changed. Then, the maintenance person may enter the room and change the batteries from the inside of the lock. After this is done, the maintenance person inserts the low battery access card to set the flag 3, and then inserts the normal access card 23 to open the lock and reset the flags 1 and 2 by causing the microprocessor to proceed through the following steps in order: steps 59, 60, 62, 64, 66, 68, 70, 90, 92, 72, 73, 74, 76, 78, 80, and 82 before jumping to the end step 84 to power down. Assuming that the newly provided batteries are fresh, upon subsequent insertions of the key card 23, the microprocessor will proceed as first noted above to open the lock without setting any of the flags 1, 2 or 3 and without flashing the red LED 26.

It should be noted that once the battery voltage drops to the level V2, there is sufficient energy and voltage level for many operations of the lock because the batteries may not be changed before many insertions of normal access cards which will drain the battery due to the powering of the electronic module 28 and the operation of the LED 26. Also, the battery voltage drops a small amount due to lowering of the ambient temperature or the passage of time and it is desirable to still provide access to the door by the emergency or low battery access card during the low temperature condition or at the later time.

Figure 4B:
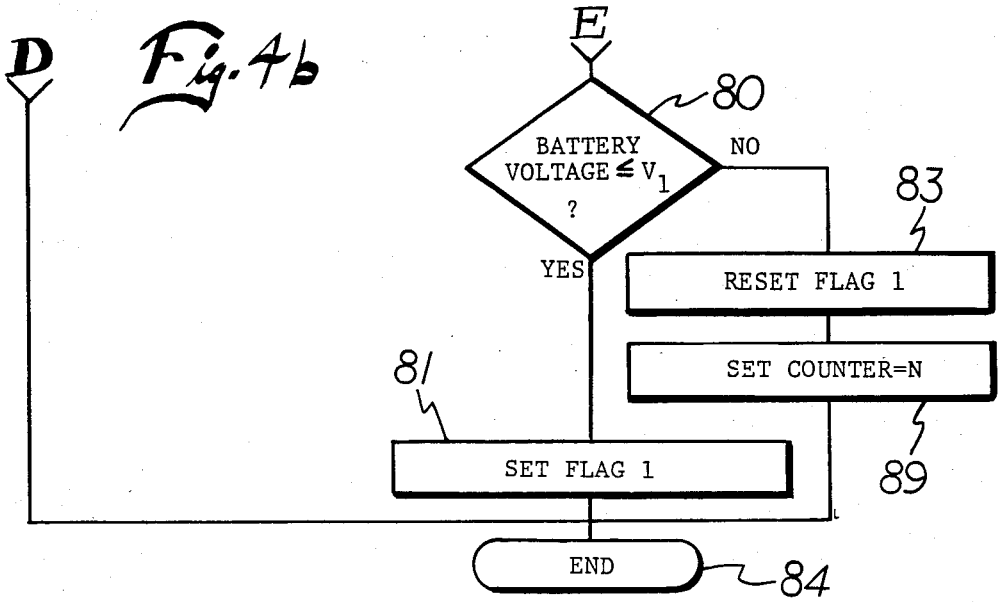
FIGS. 4(*a*) and (*b*) are top and bottom portions, respectively of a flow chart illustrating an alternate embodiment of a computer program within the electronic lock of FIG. 1 for operating a microprocessor within the lock according to another embodiment of the invention.
Figure 4A:
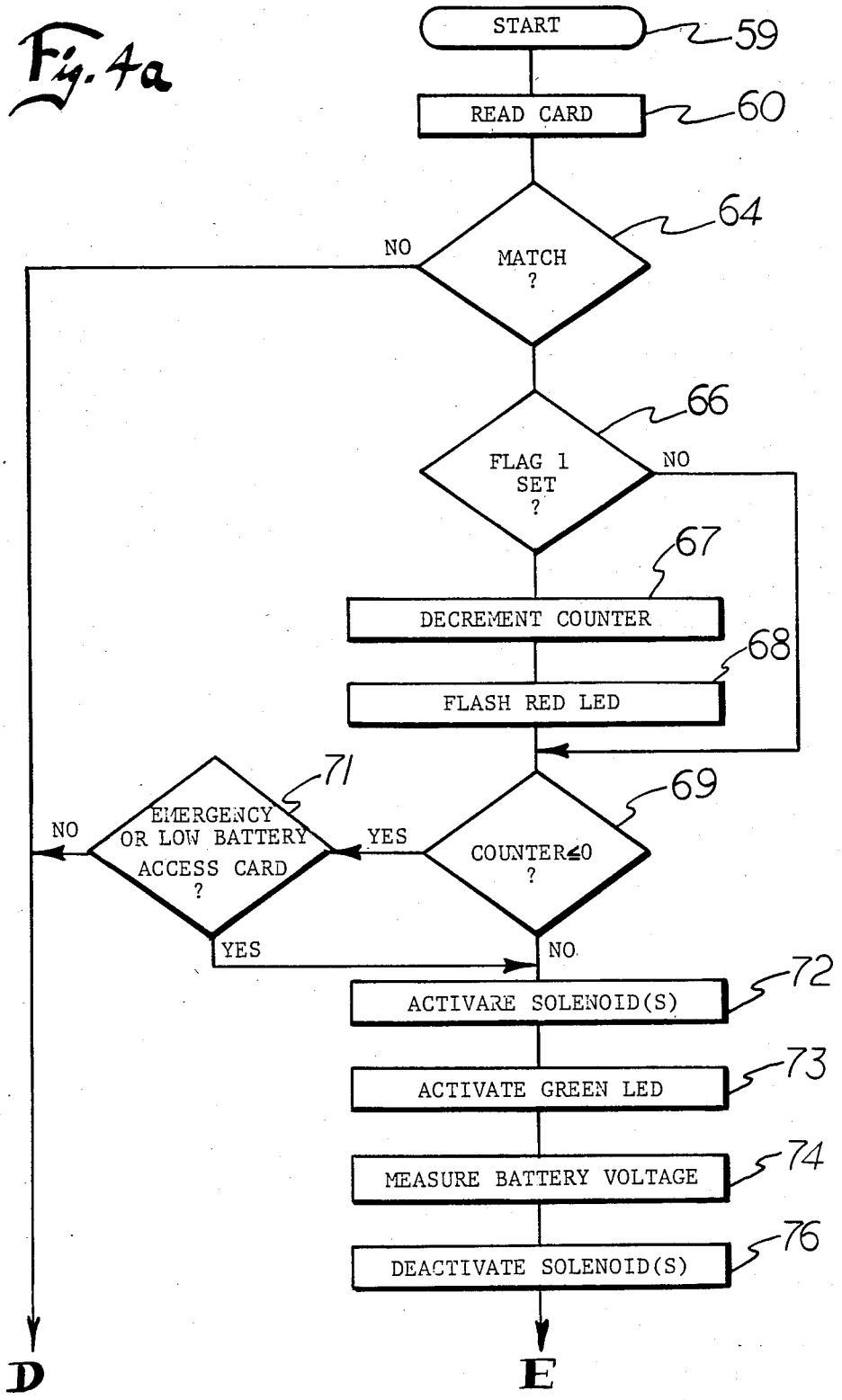

FIG. 4 is a flow chart illustrating another embodiment of the invention, which embodiment contains the components of FIGS. 1 and 2, except that the EEPROM 32 is programmed according to the flow chart of FIG. 4. In addition, steps of the flow chart of FIG. 4 which bear the same reference numeral to steps in the flow chart of FIG. 3 represent the same steps within the microprocessor. According to the flow chart of FIG. 4, if the key card 23 is inserted into recess 22 and the battery 40 is fresh, the microprocessor executes the steps 59, 60, 64 and 66, and after noting that the flag 1 is not set, reads the output of a counter (step 69). The counter is provided by the microprocessor 30 by setting a certain count in the EEPROM 32 and decrementing that count as described below. For reason described below, when the battery is fresh, the counter will originally be set to a large value N as noted below in step 89. Then, the microprocessor executes the steps 72, 73, 74, and 76 and then compares the battery voltage under load to the first predetermined level V1 (step 80). Because the battery voltage is fresh, it should exhibit a greater voltage than the level V1 so that the microprocessor proceeds to reset the flag 1 (step 83) which during the aforesaid example was already reset, and then sets the counter equal to N (step 89). Afterwards, the microprocessor powers down (step 84).

In summary, during the aforesaid operation when the battery is fresh, the lock is opened the red LED 26 is not activated, the flag 1 is reset and the counter equals "N". During many subsequent insertions of the normal access card 23, the same steps will repeated until the battery voltage drops to or below the level V1. At which time the microprocessor proceeds from the step 80 to a step 81 in which it sets the flag 1 and then powers down (step 84). Consequently, during the next insertion of the key card 23 the microprocessor proceeds through the steps 59, 60 and 64 as noted above and then to the steps 66 in which it notes that the flag 1 has been set. Then, the microprocessor decrements the counter by 1 (step 67) and flashes the red LED 26 to indicate a low battery voltage condition (step 68). Then, the microprocessor reads the output of the counter to determine its value and assuming it was originally a sizable number, for example 100, the counter is still much greater than zero and the microprocessor then executes the steps 72, 73, 74 and 76 in which it operates the lock and activates the green LED. As described in more detail below, the original count value "N" determines the number of times that the lock may be operated by the normal access card 23 after the battery voltage falls to the level V1. During these "N" operations, it is desirable that the low battery voltage will come to the attention of a maintenance person who will change the battery as described below.

After the step 76, the microprocessor again checks the battery voltage, and after noting that the battery voltage is less than or equal to V1, the microprocessor again sets the flag 1 (step 81) and then powers down (step 84). During these "N" operations of the lock, a maintenance person may insert a normal access card (or emergency access card or low battery card as described below) to obtain access through the door and then substitute fresh batteries for the partially drained batteries within the electronic locking apparatus 10. After making that substitution, the maintenance person again inserts his or her card into the recess 22, the microprocessor proceeds through the steps 59, 60, 64, 66, 67, 68, 69, 72, 73, 74, 76 and 80 and after noting that the battery voltage is now greater or equal to V1, resets the flag 1 (step 83) and sets the counter back to the value "N" (step 89). Thereafter, the electronic locking apparatus will operate according to the flow chart FIG. 4 as first described above.

If the maintenance person does not change the battery during the "N-1" operations after the battery voltage falls to the level V1, on the "Nth" operation, the microprocessor will proceed through the steps 59, 60, 64, 66, 67, 68 and 69, and after noting that the counter has reached the level zero, the microprocessor then checks whether the card which has been inserted is either an emergency card or a low battery access card (step 71). If it is either of those two cards, then the microprocessor executes the steps 72, 73, 74 and 76 to operate the lock so that the emergency may be alleviated or the batteries changed. However, if the card inserted in the recess 22 is not either an emergency card or a low battery access card, the microprocessor proceeds to the step 84 to power down. The reference level V1 and the counter value "N" have been chosen such that after the "N" operations following the battery voltage of V1, there is still sufficient energy and voltage output of the battery for the battery to operate the lock many times for reasons noted above to allow a maintenance person access to the room to change the battery, to allow emergency access and to provide tolerance in the event that the ambient temperature drops.

Next, if a maintenance person inserts either an emergency card or a low battery access card, the microprocessor will proceed through the steps 59, 60, 64, 66, 67, 68, 69, 71, 72, 73, 74 and 76 in sequence to open the lock and then through steps 80 and 81 to the power down step 84. After the maintenance person changes the batteries, the maintenance person again inserts the emergency or low battery access card to again the open the lock according to the steps 59, 60, 64, 66, 67, 68, 69, 71, 72, 73, 74 and 76 in sequence and then the microprocessor compares the battery voltage to the reference level V1 (step 80). After noting that the battery voltage is now greater than the level V1, the microprocessor resets the flag 1 (step 83) and sets the counter equal to "N" (step 89). Thereafter, whenever a normal access card is inserted into the recess 22, the lock will be operated according to the flow chart of FIG. 4 as first described above without the red LED 26 being activated.

By the foregoing, electronic locking apparatus embodying the present invention have been disclosed. However, numerous modifications and substitutions may be made without deviating from the scope of the invention. For example, the flow chart of FIG. 3 may be altered so that steps 62 and 94 are omitted and the step 60 leads directly to the step 64, the step 92 omitted and the "no" output of the step 90 leading directly to the end step 84, and the step 78 omitted with the step 76 leading directly to the step 80, and the step 90 broadened such that the insertion of either an emergency card or a low battery access card leads to the steps 72, 73, 74 and 76 in which the lock is opened. Therefore, the invention has been disclosed by way of illustration and not limitation.

I claim:

1. An electronic control for an electronic lock having a battery means for powering the lock, means for reading a keycard or other key, a lock operator, and an alarm to indicate a low battery voltage condition, said control comprising:

means for measuring the voltage of said battery means including means for transmitting a signal indicative of the sensed voltage; and processing means for receiving said transmitted voltage signal for activating said lock operator and said alarm when a valid key in inserted in the lock and read by the reading means and the magnitude of the voltage signal transmitted by said transmitting means has decreased to a first predetermined level, said processing means being further operable for activating said alarm but not said lock operator when said valid key has subsequently been inserted and read and the magnitude of the voltage signal transmitted by said transmitting means has decreased to a second predetermined level below said first predetermined level, said battery means at said second predetermined voltage level containing sufficient energy and providing sufficient voltage to drive said lock operator.

2. An electronic control as set forth in claim 1 wherein the processing means includes means for activating said lock operator upon insertion of a selected key different than the aforesaid key when said battery voltage is at or below said second predetermined voltage level.

3. An electronic control as set forth in claim 2 wherein said selected key is either a maintenance key or an emergency key.

4. An electronic control as set forth in claim 1 wherein the processing means includes means for comparing the battery voltage to said first predetermined level.

5. An electronic control as set forth in claim 4 wherein said processing means includes means for comparing the battery voltage to said second predetermined level.

6. An electronic control as set forth in claim 1 wherein said alarm is a light source and said means for activating the alarm includes means for activating said light source.

7. An electronic control as set forth in claim 6 wherein the processing means includes means for activating said light source in a flashing mode when said battery voltage is less than said first predetermined level.

8. An electronic control as set forth in claim 1 wherein the processing means includes means for activating said lock operator, independent of said alarm when said valid key is inserted and read and said battery voltage is greater than said first predetermined level.

9. An electronic control as forth in claim 1 wherein the processing means includes means for activating said alarm whenever said battery voltage is less than said second predetermined level.

10. An electronic control for an electronic lock having a battery means for powering the lock, means for reading a keycard or other key, a lock operator, and an alarm for indicating a low battery voltage condition, said electronic control comprising:

means for measuring the voltage of said battery means, including means for transmitting a signal indicative of the sensed voltage, and processing means for receiving said transmitted voltage signal for activating said lock operator and said alarm when a valid key is read and the magnitude of the voltage signal transmitted by said transmitting means has decreased to a first predetermined level from its original level, activating said alarm and said lock operator in response to a number of insertions of said valid key thereafter, said processing means being further operable for activating said alarm but not said lock operator when said valid key is inserted after said number of insertions, said predetermined level and said number being such that after said number of operations, said battery means still contains sufficient energy and provides sufficient voltage to drive said lock operator.

11. An electronic control as set forth in claim 10 wherein the processing means includes means for activating said lock operator upon insertion of a selected key different than the aforesaid key after said number of insertions of said valid key and corresponding operations of said lock operator.

12. An electronic control as set forth in claim 11 wherein the processing means includes means for comparing the battery voltage to said predetermined level.

13. An electronic control as set forth in claim 10 wherein said alarm is a light source and the processing means includes means for activating the light source in a flashing mode.

14. An electronic control as set forth in claim 10 wherein the processing means includes means for activating said lock operator independent of said alarm when said valid key is inserted and said battery voltage is above said predetermined level.

15. A method of operating an electronic lock system having a battery for powering the lock, a reader for reading a key, a lock operator connected to the battery and activated thereby, and an alarm indicating a low battery voltage condition comprising the steps of:

activating the lock operator while maintaining the alarm inactive when a valid key is inserted and read and the magnitude of the battery voltage exceeds a first predetermined level;

activating the alarm and the lock operator when a valid key is inserted and read and the magnitude of the battery voltage decreases to said first predetermined level; and activating the alarm while maintaining the lock operator inactive when a valid key is inserted and read and the magnitude of the battery voltage decreases below said first predetermined level, said last mentioned voltage being sufficient to drive the lock operator.

16. A method of operating an electronic lock system in accordance with claim 15 further including the step of:

activating the lock operator through the use of a key other than the first key when the magnitude of the voltage has decreased to said last mentioned level.

17. A method of operating an electronic lock system in accordance with claim 16 comprising using a maintenance key or an emergency key as said other key.

18. A method of operating an electronic lock system in accordance with claim 15 wherein the alarm activating steps include flashing a light source to provide said alarm.

* * * * *